US005394669A

United States Patent [19]

Hallett et al.

[11] Patent Number: 5,394,669

[45] Date of Patent: Mar. 7, 1995

[54] LOCKING CONNECTION FOR SUSPENDED CEILING SYSTEM

[75] Inventors: Chester W. Hallett; Carl K. McClure, both of Lancaster, Pa.

[73] Assignee: Armstrong World Industries, Inc., Lancaster, Pa.

[21] Appl. No.: 110,700

[22] Filed: Aug. 23, 1993

[51] Int. Cl.[6] ..... E04B 1/38

[52] U.S. Cl. ..... 52/506.07; 52/726.2; 52/664

[58] Field of Search ..... 52/506.7, 506.6, 664, 52/667, 668, 726.1, 726.2

[56] References Cited

U.S. PATENT DOCUMENTS

| | | | |
|---|---|---|---|
| 2,873,828 | 2/1959 | Zitomer | 52/667 |
| 2,946,414 | 7/1960 | Gordon et al. | 52/476 |
| 3,093,221 | 6/1963 | Purdy | 403/219 |
| 3,096,862 | 7/1963 | Purdy | 52/664 X |
| 3,584,904 | 6/1971 | Lickliter | 52/664 X |
| 3,675,957 | 7/1972 | Lickliter et al. | 52/664 X |
| 4,548,013 | 10/1985 | Briceno | 52/667 |

*Primary Examiner*—Carl D. Friedman
*Assistant Examiner*—Robert J. Canfield

[57] ABSTRACT

A locking connection fastens two oppositely positioned cross runners perpendicular to another runner. Compressible tabs on the cross runners are inserted in slots of the other runner to fasten the three runners together. The tabs at one connection are positioned one above the other and the tab on one cross runner projects into a cutout of the opposite cross runner. Two cutouts on the opposite sides of each tab lock the runners together.

5 Claims, 4 Drawing Sheets

LOCKING CONNECTION FOR SUSPENDED CEILING SYSTEM

BACKGROUND OF THE INVENTION

Field of the Invention

This invention grew out of a need for a connection method for a wire reinforced, extruded PVC product intended to duplicate the function of steel grid. The traditional method for connecting steel grid elements at intersections is to attach a separate piece containing the locking configuration to each end of the structure using a staking approach. This addition of a separate device requires that the locking portion of each end are offset to allow the center line of the grid to pass between the mating pieces. The product herein is made from extruded PVC which is not well suited to providing the required offset. Additionally, the use of a riveting process would not provide adequate strength between the plastic and the steel clip. Another traditional method for connecting steel grid elements is to form the locking configuration into the ends during the pressing operation of their manufacture. Again, the approach is well suited for steel but not for extruded PVC.

A less common method to connect the grid elements is the use of a hook end detail. This approach provides a hook on either end which allows mating pieces to pass through a main beam and connect in an over and under fashion. The need for the offset is eliminated as is the necessity for locating and attaching a separate piece. However, the two cross tees must each slide into their respective slot and then drop into place. The product herein with the dimensional face requires coping at each cross tee end and the connecting method must allow the opposing tee's to move only horizontally as they enter and lock into the main tee. This does not happen with the hook end detail.

U.S. Pat. No. 3,093,221 describes a method which uses a straight-in approach for the cross tees. However, it requires a separate metal clip which locks onto the cross tee ends. The connection means described herein requires no separate piece.

U.S. Pat. No. 4,548,013 describes a version of the hook end detail made using extruded aluminum. This approach does not require a separate clip but is not suitable for the straight-in approach required for a dimensionally decorated and coped design.

SUMMARY OF THE INVENTION

This invention is aimed at providing a cross runner connection means which incorporates a metal reinforced PVC structure which has a dimensionally decorative face and coped ends on each of the cross tees. For the invention to be successful, it must incorporate several distinct characteristics which this invention demonstrates.

When a runner incorporates a dimensionally decorative face, the ends are coped such that the intersection of a main beam and two cross tees form an attractive joint. The connection method used must allow the cross tees to move into their respective slots in only a horizontal plane and continue in that horizontal plane until locking is complete.

The installer of the system needs an indicator as to when he/she has properly inserted the cross tee and has successfully locked it in place. The invention provides an audible "click" when the cross tee reaches its fully seated position. The click occurs as a result of the parts snapping into place and hence is accurately communicated to the installer.

There needs to be perfect alignment of the two cross tees when they are snapped into place through the main tee. The over-under approach used in this design achieves the alignment with no offset.

In that the product must in some cases compete with steel grid, it must be economical to produce. The design used in the invention allows for the shape to be cut out of the center web of the cross tee material. The PVC lends itself to being punched out with a simple air operated punch and die assembly with a single hit.

For the system to be economical and simple to use, it should not require additional parts to make the cross tee connection. Other existing systems use a clip device which makes installation more complicated and the system more costly. This invention uses no additional parts to make the connection.

This application discloses a connection method and connection for a suspended ceiling system manufactured from PVC. The PVC ceiling system is comprised of main runners and cross tees. This connection method provides for cross tees to be inserted into slots located along the length of main runners or other cross tees. The cross tee ends incorporate a tab which, when inserted into the undersized slot, is allowed to compress in a controlled way such that when the tab is completely through the slot it decompresses, locking itself in place. The slots and tabs are located such that when an intersection is made with a main runner and two opposing cross tees the tabs will be in alignment, one above and one below. This allows for a straight-in installation of the cross tees and their subsequent perfect alignment with one another.

DESCRIPTION OF THE INVENTION

Figure 2:
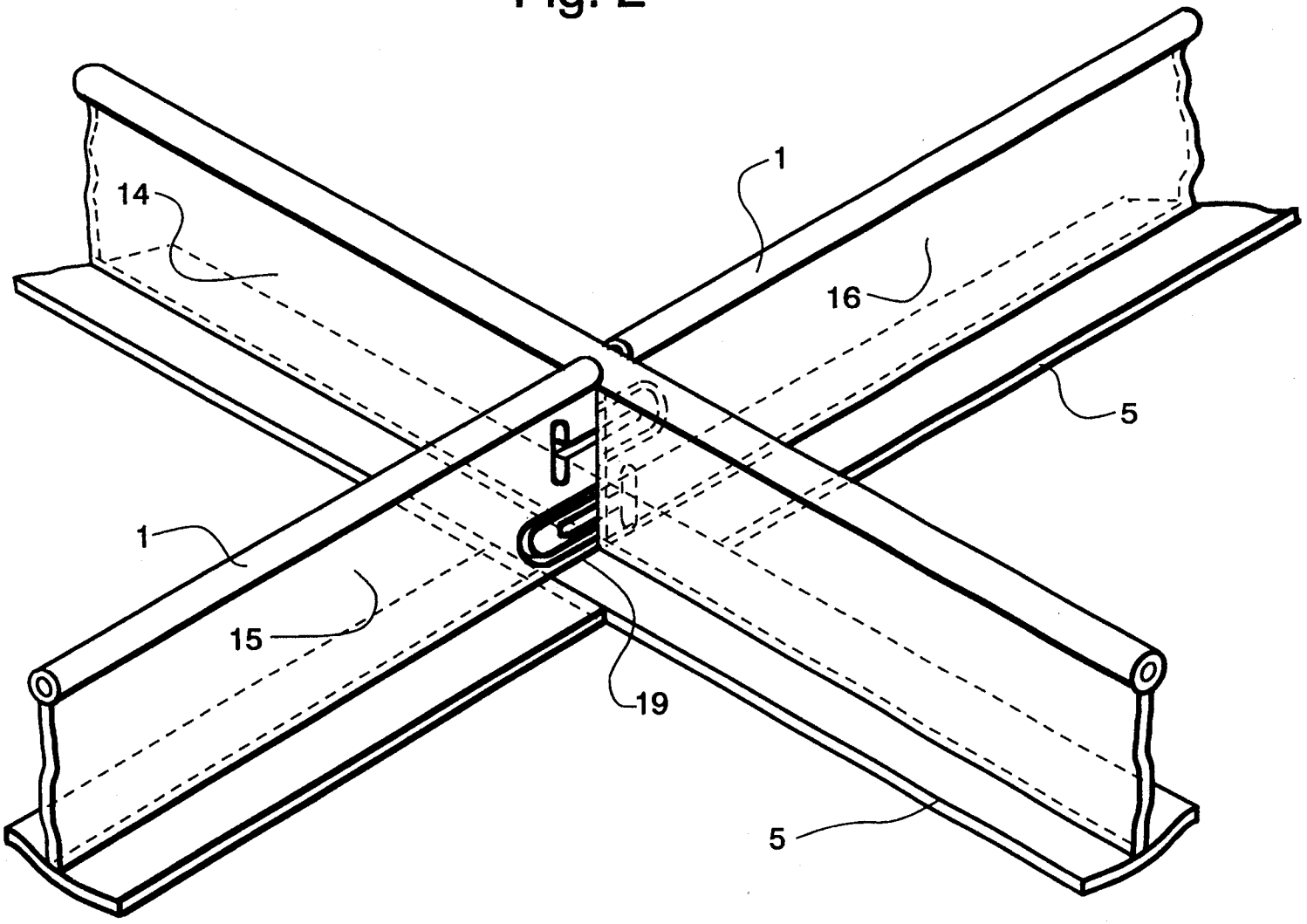
FIG. 2 is a perspective view of an assembled main beam with two cross tees locked through it.

This invention is primarily intended for, but not restricted to, use on a suspended ceiling system manufactured from wire reinforced PVC runner as described in U.S. patent application Ser. No. 933,093, filed Aug. 21, 1992, entitled "Composite Ceiling Grid". The runner has a bulb 1, web 2, flanges 5, and an end detail for the web 2. FIG. 2 shows a portion of that suspended ceiling system consisting of main beam 14 (first runner) and opposite ends of two cross tees 15 and 16 (second and third runners). The end details of each cross tee are different. The tab which locks into the main beam 14 on the left cross tee 15 is formed into the upper portion of the web while the opposite end which would be identical to the end of runner 16 is formed on the lower portion of the web. The ends are different but they cannot be assembled incorrectly, since each end will fit only in its respective slot. The fact that the slots which the tabs fit into are vertically aligned insures that the flange 5 of each cross tee are in perfect alignment. This is especially critical in that when several cross tees are viewed in an assembled ceiling they must appear to be continuous and without any unsightly steps. The locking tabs are intended to lock the ceiling grid system together. The vertical load is intended to be carried by the flange 5 of the main beam which the cross tee is resting on at point 19. Consequently, this arrangement does not place shear force on the tab but rather depends on it only to resist tensional forces.

Figure 1:
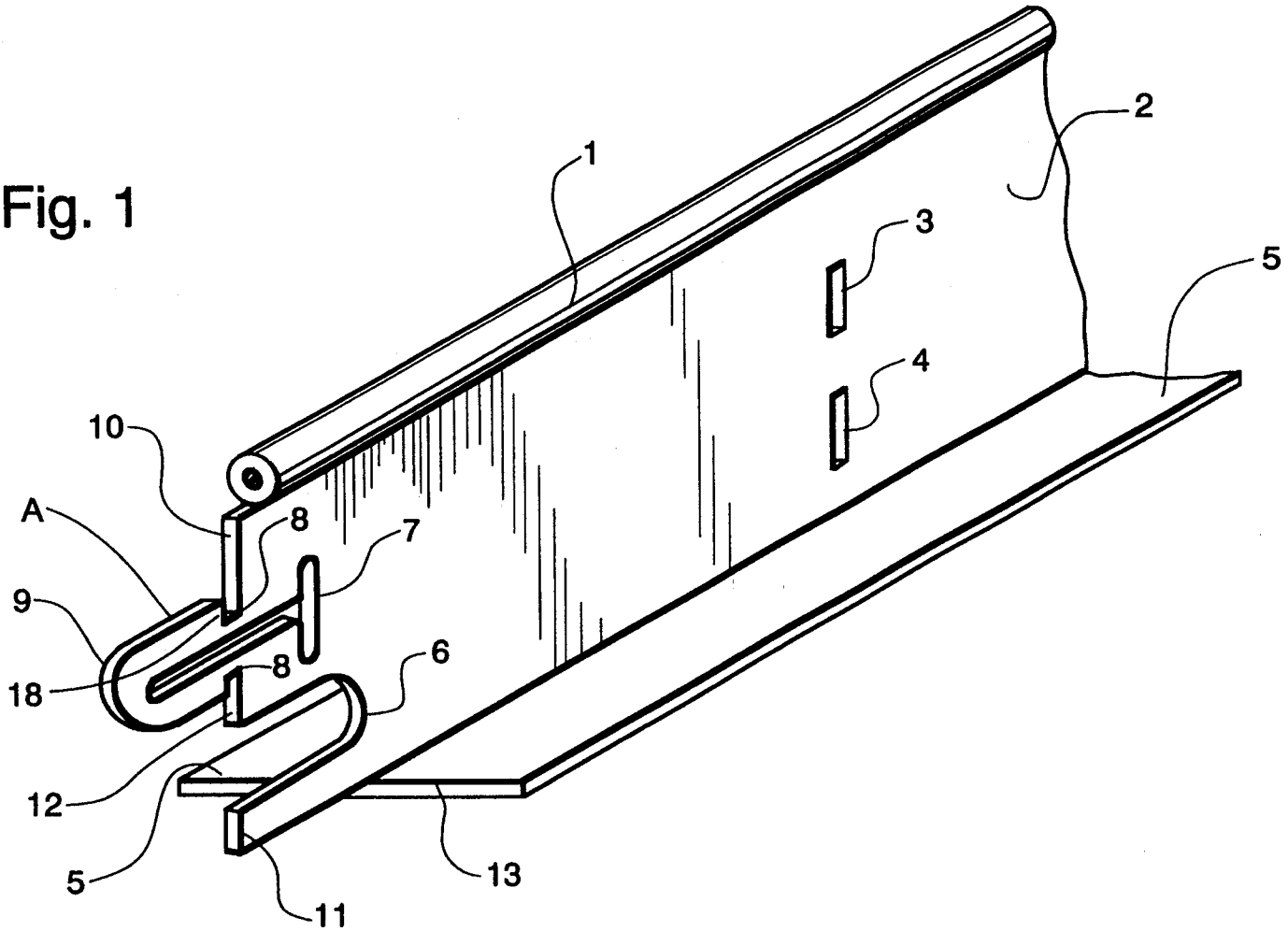
FIG. 1 is a perspective view of the end of a four foot cross tee showing the locking tab and associated slot in the web of the piece.

FIG. 1 shows one end and the center slots 3 and 4 of a four foot cross tee (first runner). The tab 9 is intended to be inserted into its associated slot 3 on a perpendicular cross tee or main beam. The height of slot 3 is smaller than the height of tab 9 at point A. Hence, when the tab 9 enters the slot 3, it must compress in order to fit. This is achieved by the unique T-shaped slot 7 which allows the tab 9 to be reduced in height as it passes into the slot. When the tab reaches its fully inserted position, the tab is allowed to spring open due to the fact that the cutouts 8 have reached the slot. When this occurs, the tab gives off an audible snap indicating to the operator that the installation is complete. At this time, the end 10–12 of the web 2 of cross tee 15 or 16 engages the web 2 of runner 14. The end 13 of the flange 5 of cross tee 15 or 16 engages the side of flange 5 of runner 14. The cross tee is now prevented from being removed by the fact that the distance between the bottom portion of each cutout 8 of the tab 9 just fills the slot 3. Removal is prevented by the vertical portion 18 of the slot 8. To facilitate the opposing tab, a cutout 6 is cut into the web section 2.

Figure 3:
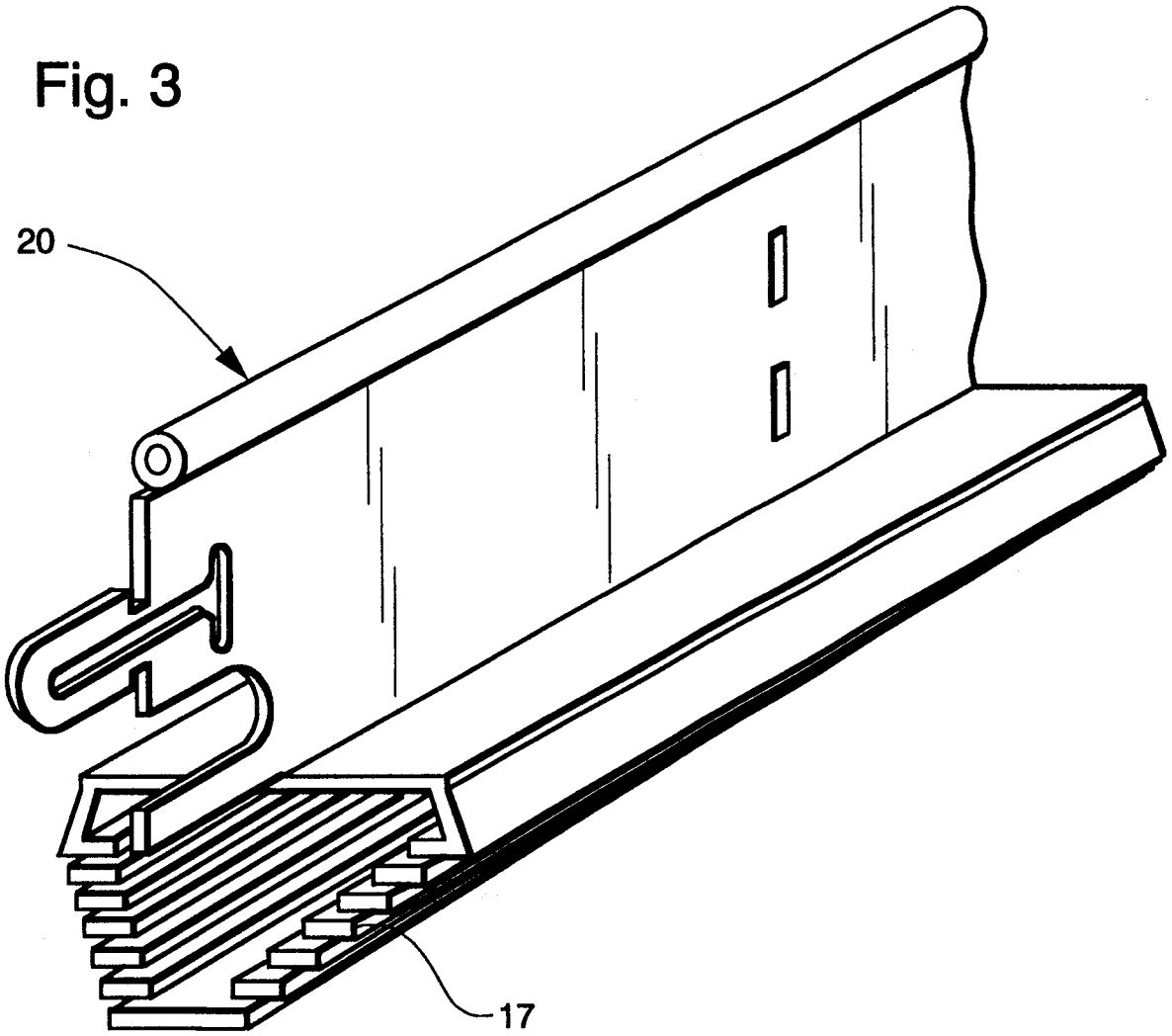
FIG. 3 is a perspective view of a four foot cross tee with the coped decorative face.

FIG. 3 depicts a portion of a four foot cross tee with a decorative face 17. The decorative face is formed during extrusion and can take on a multitude of shapes. The face 17 is coped during the fabrication process to allow it to mate with the corresponding perpendicular piece. For the connection method to work, the tab must enter and reach its home position while in a horizontal plane.

The coping as shown in FIG. 3 required on the decorative faced version as well as the cutback on the flat faced version will be accomplished using routers with cutters designed to match the specific pattern. The tab and slot portions of the design can be easily cut out using simple dies cut to the configurations shown. Since the PVC is relatively soft, air cylinders will provide the required force necessary to punch out the design.

Figure 4:
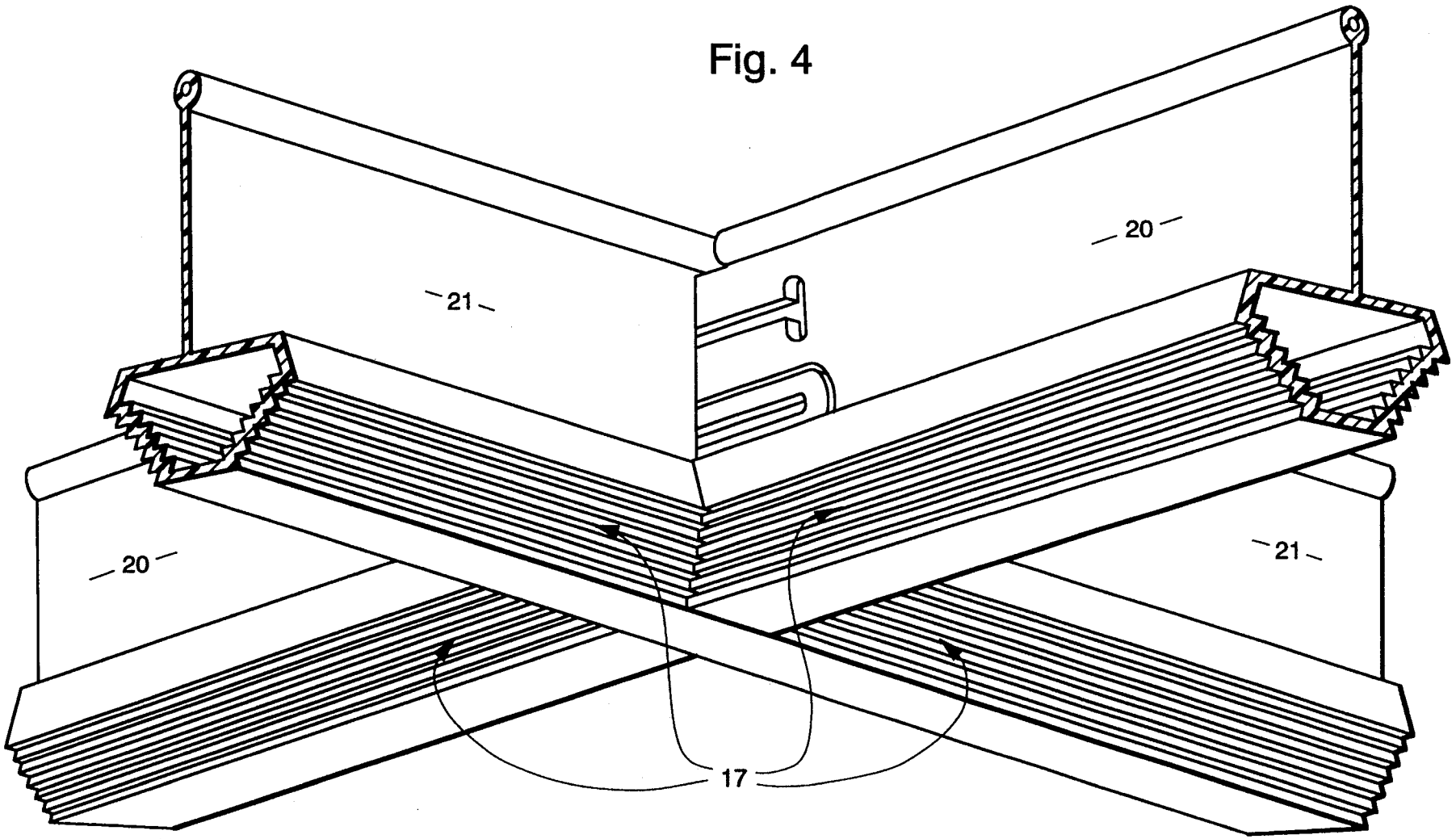
FIG. 4 shows a coped connection as viewed from the flange side of the runners.

FIG. 4 shows the runners viewed from the decorative face 17 where the coped edge of runner 20 mates with the stepped decorative face for runner 21.

What is claimed is:

1. A plastic ceiling runner comprising:

a) an elongated runner having a vertical web with an upper and lower side and two ends, transverse flanges extending from the lower side of the vertical web to either side of the vertical web;

b) each end of the vertical web having a tab extending therefrom with top and bottom edges and a tab shaped cutout in the vertical web adjacent the tab, one end of the runner having the tab positioned above the cutout and the other end of the runner having the tab positioned below the cutout, the tab on one end of the vertical web being positioned to be inserted in the cutout of the other end of an identical runner; and c) each end having an elongated slot means therein with a long horizontal dimension, the slot means positioned with its long dimension being mostly in the tab to permit the tab top and bottom edges to be compressed when the tab of one runner is inserted in the tab shaped slot means of another runner.

2. A plastic ceiling runner as set forth in claim 1 wherein:

a) the aforesaid elongated slot means of each end having a T-shape with a long horizontal side and short vertical side, the slot positioned with its T-shape such that the short side is positioned in the vertical web perpendicular to the transverse flanges and its long side extends into the tab.

3. A plastic ceiling runner as set forth in claim 2 wherein:

a) a cutout is provided in both the top and bottom edges opposite each other and adjacent where the tab joins to the vertical web.

4. A suspended ceiling system comprising:

a) a first ceiling runner with a vertical web having two vertical slots in the vertical web, one vertical slot positioned directly above the other vertical slot;

b) a second and third runner, each comprising:

1) an elongated runner having a vertical web with an upper and lower side and two ends, transverse flanges extending from the lower side of the vertical web to either side of the vertical web;

2) each end of the vertical web having a tab extending therefrom and a tab shaped cutout in the vertical web adjacent the tab, one end of the runner having the tab positioned above the cutout and the other end of the runner having the tab positioned below the cutout, the tab on one end of the vertical web being positioned to be inserted in the cutout of the other end of an identical runner; and 3) each end having a T-shaped slot therein with a long horizontal side and short vertical side, the slot positioned with its T-shape such that the short side is positioned in the vertical web perpendicular to the horizontal flanges and its long side extends into the tab; and c) the tab on one end of the second runner being positioned in the upper vertical slot on one side of the first runner and the tab on the other end of the third runner being positioned in the lower vertical slot on the opposite side of the first runner, each said tab projecting into the cutout of the opposite runner.

5. A suspended ceiling system as set forth in claim 4 wherein:

a) the tabs of the second and third runners each has a top and bottom side, a cutout is provided in both the top and bottom sides opposite each other and adjacent where the tab joins to the vertical web; and b) said vertical slots have a height less than the height of the tabs from their top to bottom sides, said tabs due to the T-shaped slots therein slip through the vertical slots of the web of the first runner and the cutouts on each tab engage the web of the first runner to lock the second and third runners to the first runner.

* * * * *